US005193323A

United States Patent [19]

Ishii et al.

[11] Patent Number: 5,193,323

[45] Date of Patent: Mar. 16, 1993

[54] SAFETY MONITORING METHOD FOR USE IN ACTIVE SEISMIC RESPONSE AND WIND CONTROL SYSTEM

[75] Inventors: Koji Ishii; Masao Iizuka; Jun Tagami, all of Chofu; Toshikazu Yamada, Tokyo; Katsuyasu Sasaki, Tokyo; Yoshiki Ikeda, Tokyo, all of Japan

[73] Assignee: Kajima Corporation, Tokyo, Japan

[21] Appl. No.: 695,095

[22] Filed: May 3, 1991

Related U.S. Application Data

[62] Division of Ser. No. 481,979, Feb. 20, 1990, Pat. No. 5,016,290.

[30] Foreign Application Priority Data

Feb. 23, 1989 [JP] Japan ..... 1-43563

[51] Int. Cl.[5] ..... E04B 1/00

[52] U.S. Cl. ..... 52/741.3

[58] Field of Search ..... 52/167 R, 167 DF, 1, 52/741

[56] References Cited

U.S. PATENT DOCUMENTS 4,799,339 1/1989 Kobori et al. ..... 52/1

5,046,290 9/1991 Ishit et al. ..... 52/1

*Primary Examiner*—David A. Scherbel

*Assistant Examiner*—Creighton Smith

*Attorney, Agent, or Firm*—James H. Tilberry

[57] ABSTRACT

A safety monitoring device is provided for the use in an active seismic response and wind control system for exerting a control force, which restrains the vibration of a structure due to disturbances such as earthquake and wind, from an actuator in response to the above vibration. The safety monitoring device measures the work done of a seismic response control force and judges the work done of the seismic response control force to be positive or negative, so that whether or not the seismic response control is properly carried out by the actuator is judged. If any abnormality is found, a stop signal or the like is generated to stop the seismic response and wind control system, whereby the safety of the structure is ensured.

4 Claims, 5 Drawing Sheets

SAFETY MONITORING METHOD FOR USE IN ACTIVE SEISMIC RESPONSE AND WIND CONTROL SYSTEM

This is a division of application Ser. No. 07/481,979, filed Feb. 20, 1990, now U.S. Pat. No. 5,046,290.

BACKGROUND OF THE INVENTION

1. Field of the Invention

This invention relates to a device for controlling the safety of an active seismic response and wind control system installed in a structure in order to reduce the vibration of the structure caused by an external force such as earthquake and wind.

2. Description of the Prior Art

This applicant has disclosed in Japanese Patent Laid-open Nos. Sho 62-268478 and Sho 63-78974 an active seismic response and wind control system, which consists of an additional mass and an actuator and is provided on the top or the like of a structure, and in which the operation of the actuator is controlled when a structure is subjected to an external force such as earthquake and wind, whereby the reaction given to the weight as an additional mass applies a vibration control force to the structure body.

FIG. 6 shows an outline of the active seismic response and wind control system as noted above, in which a weight 12 used as an additional mass is provided on the top of a structure 1, for example, in such manner that the weight 12 is substantially separated from the structure 1, and an actuator 3 is interposed between the weight 12 and a portion of the structure 1. When the structure 1 vibrates under the action of earthquake, wind or the like, a sensor 13*a* provided on the structure 1 senses the vibration of the structure 1 to send a signal to a control circuit. The control circuit sends an output signal corresponding to the vibration of the structure 1 to the actuator 3 and controls the actuator 3. Further, a sensor 13*b* is provided on the side of the actuator 3 to feed back the motion of the actuator 3, whereby the actuator 3 is accurately controlled.

Now, though the seismic response and wind control system has no difficulty under the normal operation, it should be contemplated that any abnormalities in the drive or control of the system take place by various causes such as a reduction or excess of hydraulic pressure, a shortage of oil amount on a hydraulic pressure source, an overload (load and stroke) on the actuator, or unexpected causes in devices utilizing the hydraulic pressure, for example.

Particularly, since the active seismic response and wind control system makes use of external energy, it is liable to instead apply the vibration to the structure due to the inverse action of the external energy.

SUMMARY OF THE INVENTION

The present invention provides a device for sensing the vibrational phenomenon of a structure given by an active seismic response and wind control system, whereby other safety means is permitted to provide for stopping the operation of the seismic response and wind control system, which is under the abnormal condition, to preserve the structure, for example.

In an active seismic response and wind control system for exerting a control force, which restrains the vibration of a structure, by an actuator in response to the vibration of the structure, a safety monitoring device according to the present invention comprises vibration detecting means such as a speedometer provided on the structure side, and load measuring means such as a load meter provided on the actuator side. In addition to the vibration detecting means and the load measuring means, the safety monitoring device further comprises work done calculating means consisting of a multiplier, and an integrator or the like, and control status judging means consisting of a comparator or the like, whereby the work done of the actuator relative to the structure is obtained from the vibration (speed) detected by the vibration detecting means and the load measured by the load measuring means, and which acts on the structure a seismic response control force or a vibrational force is judged according to the positive or negative sign of the work done to confirm the safety of the structure.

The state of energy of a seismic response structure which is subjected to the vibrational disturbances such as earthquake and wind is represented by the following formula (in the case of earthquake);

$$\frac{1}{2} m\dot{x}^2 + \frac{1}{2} K\dot{x}^2 + \int_0^t Fc\dot{x}dt = \int_0^t Fe\dot{x}dt \quad (1)$$

where m: mass of structure

K: stiffness of structure

Fc: seismic response control force

Fe: seismic force, and x and $\dot{x}$; deformation and speed of structure

Referring to the formula (1), first and second terms on the left side represent the vibrational energy Fs of the structure, the third term on the left side represents the work done Fc ($\dot{x}$ dt=dx) of the seismic response control force and right side represents the work done Fe the earthquake. Thus, the formula (1) is expressed by the use of Fs, Fc and Fe as follows:

$$Fs + Fc = Fe \quad (2)$$

From the formula (2), it comes out that the sum of the vibrational energy of the structure and the work done of the seismic response control force is equal to the work done of the seismic force.

Hence, if a value of the work done of the seismic response control force is positive, the vibrational energy of the structure is reduced since the work done of the seismic force is constant and positive. On the contrary, if a value of the work done of the seismic response control force is negative, the vibrational energy of the structure will be increased up to the work done of the seismic force plus the work done of the seismic response control force.

Further, the above description covers the overall time of earthquake. When it is considered only for a short time, the increment of the work done of earthquake for the short time may be negative. Since this fact, however, shows that the seismic force, in addition to the seismic response control force, also cooperates with the seismic response control action, it is neeessary for restraining the vibration of the structure that the increment of the work done of the seismic response control force is always positive.

Hence, a principle that the status of seismic response control or vibration application of the structure can be judged by measuring the work done of the seismic response control force to examine the positive or negative thereof is established.

The invention provides a safety monitoring device for the use in a structure on the basis of the above principle, in which the speed $\dot{x}$ and the seismic response control force Fc of the structure are measured to output a signal to another safety device (a device stop circuit, for example) when the status of seismic response control or vibration application of the structure is judged to be dangerous from the integrated value (work done) of the speed and the seismic response control force of the structure.

OBJECT OF THE INVENTION

A principal object of the present invention is to provide a safety monitoring device which measures the work done of an active seismic response and wind control system relative to a structure, and judges according to the sign of the measured work done whether the proper control is carried out or the vibration phenomenon takes place, whereby the seismic response and wind control effect is judged from the standpoint of the safety of the structure. This means that the structure is prevented from being put into a dangerous condition due to the vibration phenomenon even if no abnormality is found in the seismic response and wind control system itself, for example.

Another object of the invention is to provide a safety monitoring device having a simple mechanism and functioning surely.

DETAILED DESCRIPTION OF PREFERRED EMBODIMENTS

Figure 1:
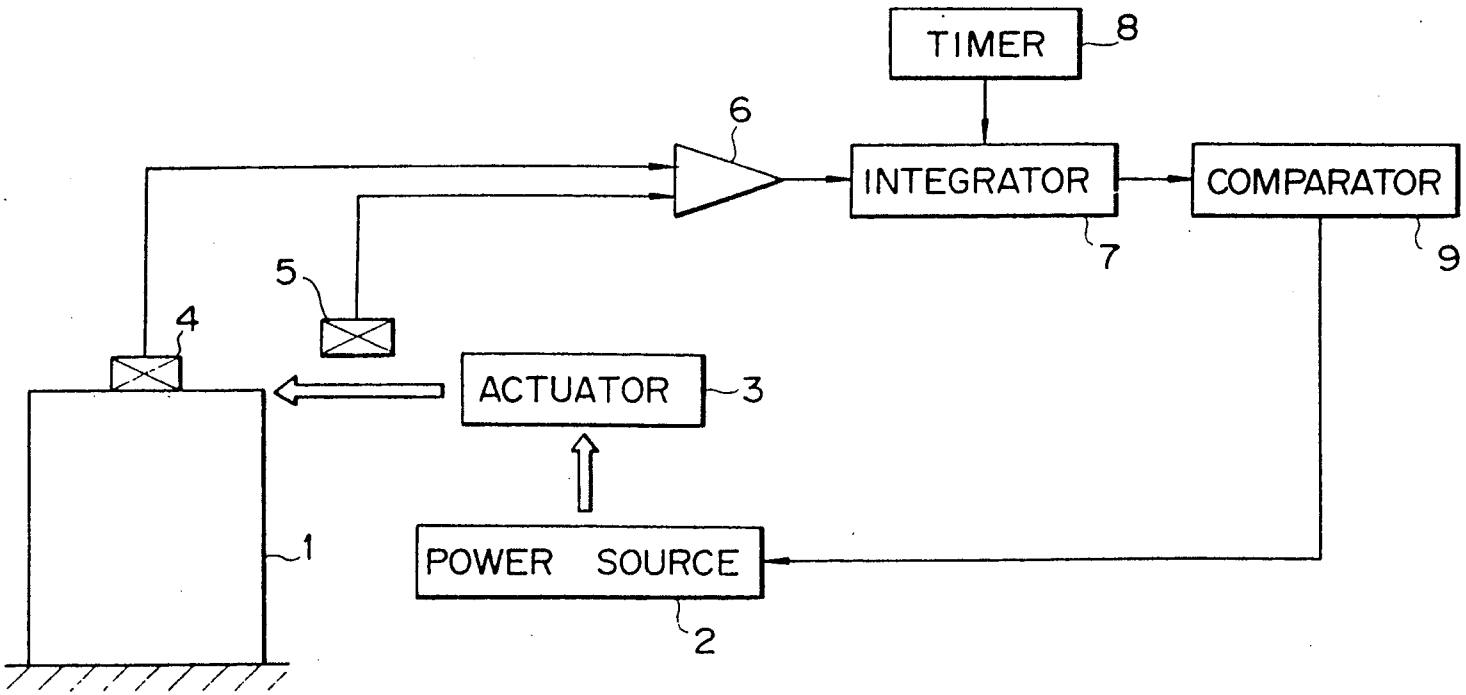
FIG. 1 is a block diagram showing n outline of an active seismic response and wind control system and a safety monitoring device according to the present invention.

Next will be described the present invention with reference to an embodiment shown in the drawings.

Figure 4:
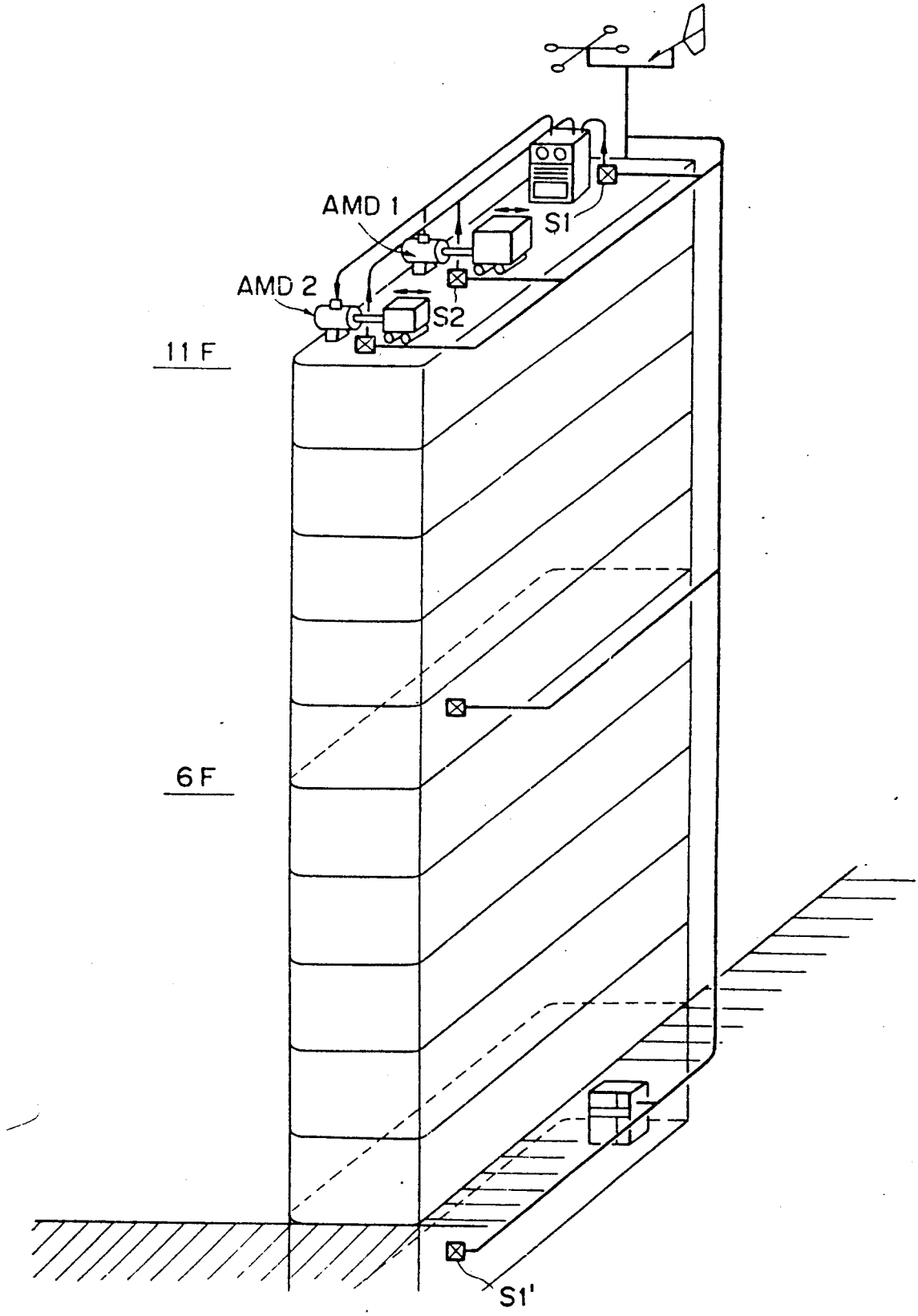
FIG. 4 is a schematic view showing the arrangement of the seismic response and wind control system relative to a structure.
Figure 5:
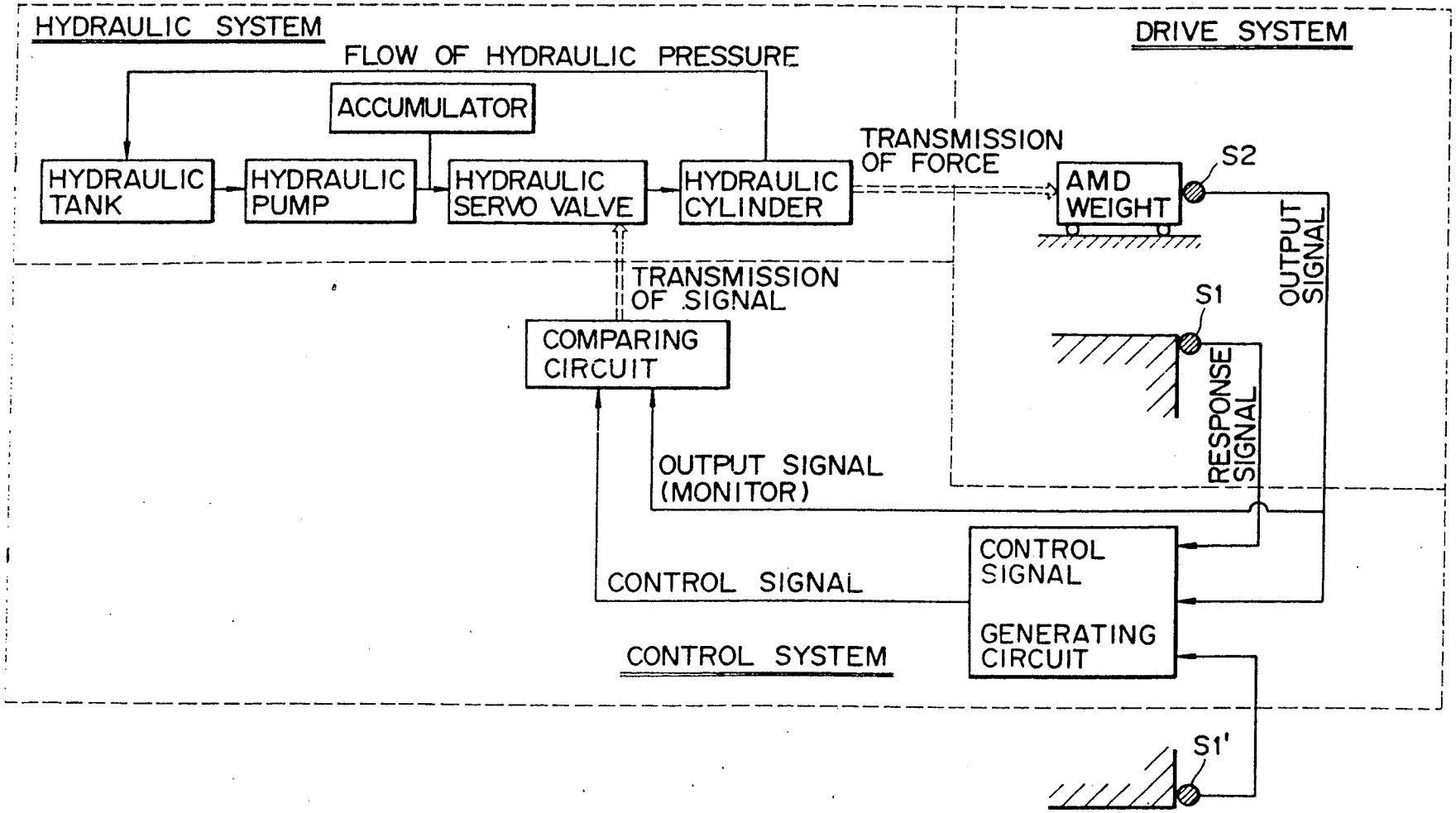
FIG. 5 is a conceptional diagram showing a signal hydraulic system of the seismic response and wind control system.
Figure 6:
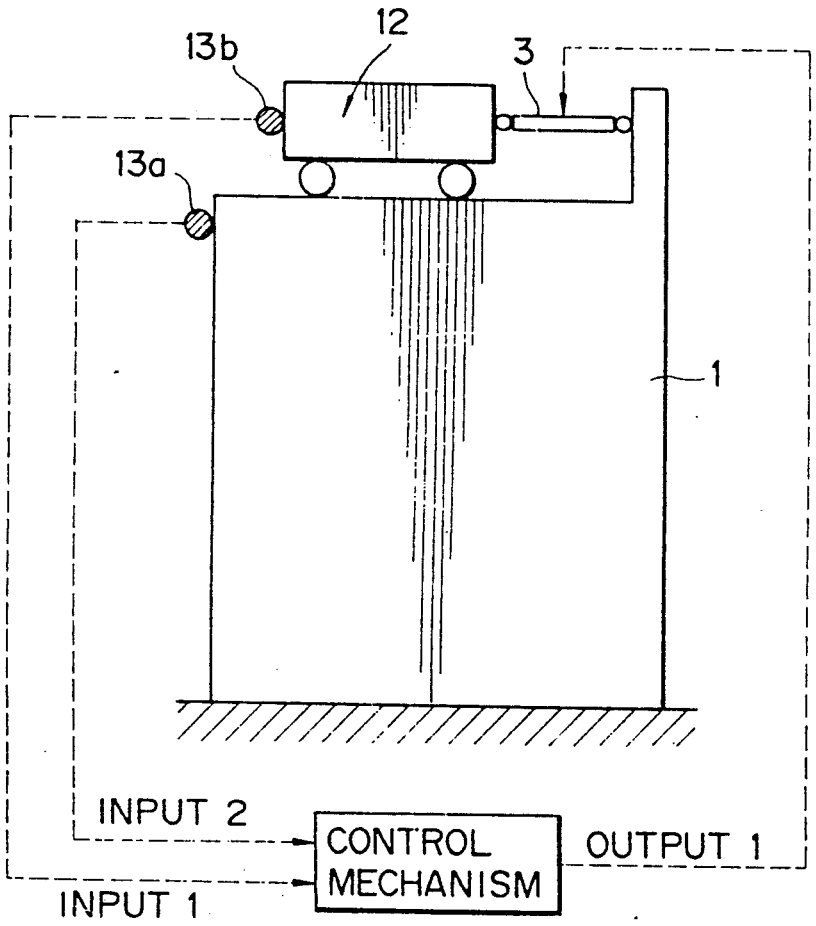
FIG. 6 PRIOR ART
FIG. 6 is a basic conceptional view showing a prior art seismic response and wind control system.

FIGS. 4 and 5 show schematically an embodiment of a seismic response and wind control system (designated by Active Mass Driver abbreviated to AMD in the drawings), to which a safety monitoring device according to the present invention is applied. In this embodiment, use is made of a hydraulic cylinder as an actuator.

FIG. 4 shows a main seismic response and wind control system AMD1 having a four ton of a weight (the weight of a structure is assumed to be 400 t) and an auxiliary seismic response and wind control system AMD2 having a one-ton of a weight to cope with the torsion of the structure, which are arranged in parallel (AMD1 is arranged in the center and AMD2 is arranged at the end) on the top of a so-called pencil building.

For simplification, hereinafter will be described only the control of the main seismic response and wind control system. Accelerometers used as sensors are provided respectively on the top and the underground portion of the building structure. By obtaining a difference between the vibration sensed by a sensor S1 provided on the top and that sensed by a sensor S1' provided on the underground portion, the vibration of the structure is detected. Basically, a control force having the phase, which is offset by 90° from the vibration of the structure, is applied from the hydraulic cylinder serving as an actuator to the structure, so that the vibration of the structure will be restrained. In order to apply the controlling force having the phase, which is offset by 90° to the structure, it is necessary for a control circuit to generate a control signal in consideration of a mechanical lag and an output level. Also, by providing a sensor S2 in the weight position of the seismic response and wind control system to feed back the motion of the weight or further composing a responsive signal provided from the structure side and adjusted with respect to the phase and the output level and a responsive signal provided from the weight side and adjusted with respect to the phase, the control of the weight in the seismic response and wind control system is damped to provide the stable control.

FIG. 5 is a conceptional diagram showing a signal hydraulic system of the seismic response and wind control system, in which the accerometers (S1, S1', S2) used as sensors are provided respectively on the top and the underground portion of the structure and the weight of the seismic response and wind control system to send the responsive signals therefrom to a control signal generating circuit.

After the phase adjustment and the amplification are carried out in the control signal generating circuit, the control signal is sent from the control signal generating circuit to a comparing circuit, whereas the output signal is also sent to the comparing circuit from the sensor S2 for sensing the motion of the weight to perform the feedback control.

The control signal processed from the comparing circuit is sent to a hydraulic servo valve, which is mounted on the hydraulic cylinder, to control the hydraulic servo valve. The hydraulic system constitutes a circulation passage consisting of a hydraulic tank, a hydraulic pump, the hydraulic servo valve and the hydraulic cylinder, and an accumulator is provided between the hydraulic pump and the hydraulic servo valve.

The hydraulic cylinder is operated by the control of the hydraulic servo valve to give the reaction to the structure, so that a force to restrain the vibration of the structure is applied to the weight of the seismic response and wind control system.

FIG. 1 shows the arrangement of a safety monitoring device according to the present invention in principle under the principal situation that a power source 2 and an actuator 3 exert the seismic response and wind control action to the structure 1, as an embodiment of the safety monitoring device for the use in an active seismic response and wind control system according to the invention.

The detected value of a speedometer 4 and that of a seismic response control load meter 5 are sent to a multiplier 6, and integrated by an integrator 7 to be then judged by a comparator 9. The comparator 9 sends a stop signal to the power source 2 if any abnormalities take place. Further, the judgement by the comparator 9 is done in consideration of not only the positive or negative sign, but also a value having some degrees of allowance for the judgement.

In the embodiment shown in FIG. 1, the timing for judgement is carried out at a time interval $T_1$ corresponding to the primary natural period of the structure 1, and a timer 8 sends a signal to the integrator 7 at intervals of $T_1$ time. The integrator 7, upon reception of the signal, sends the value, which is integrated up to now, to the comparator 9 and then sets the integrating value to zero to again integrate the value only for the $T_1$ time. That is, in the embodiment shown in FIG. 1, the safety of the structure is judged at intervals of $T_1$ time. Further, $T_1$ may be defined as a half or twice as large as the natural period of the structure centering therearound.

Figure 2:
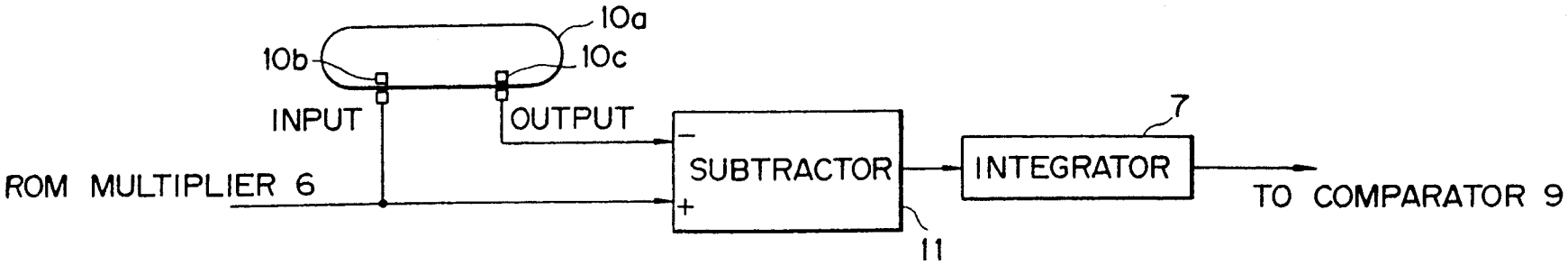
FIGS. 2 and 3 are fragmentary block diagrams showing an embodiment in the case where the safety is judged at a shorter interval, respectively.
Figure 3:
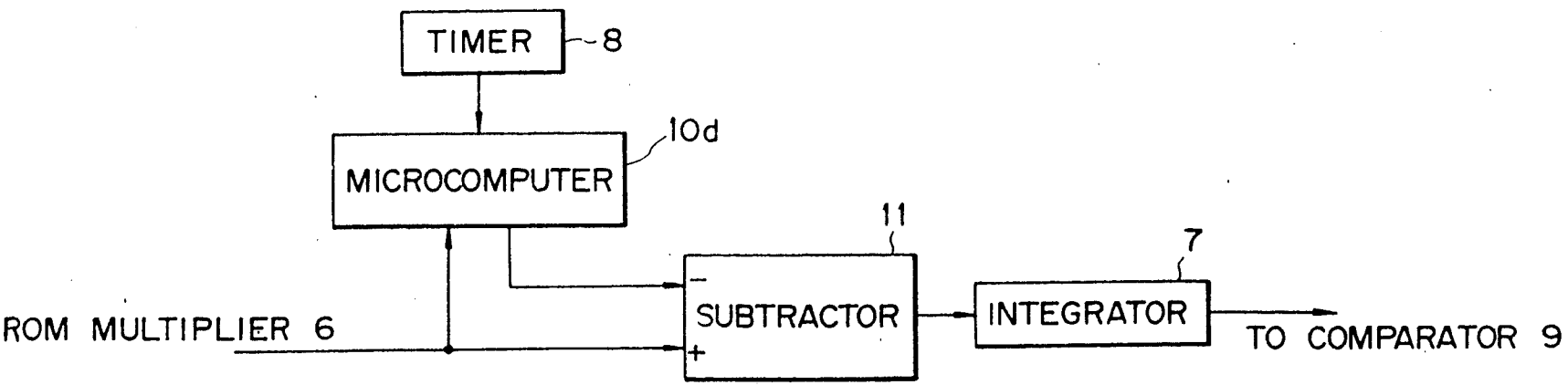

On the other hand, in the embodiments shown in FIGS. 2 and 3, the timing for the judgement is taken as finely as possible.

FIG. 2 shows an embodiment of an analog system, in which the output of the multiplier 6 is recorded on a magnetic tape or magnetic disk 10*a* through an input unit 10*b*. The magnetic tape or magnetic disk 10*a* rotates endlessly, and $T_1$ time of the natural period of the structure 1 is set to elapse just when the value written by the input unit 10*b* rotates to exactly reach an output unit 10*c*. A difference between the output of the multiplier 6 and the value before $T_1$ time, which is output from the magnetic tape or magnetic disk 10*a*, is calculated by a subtracter 11, the output of which is input to the integrator 7. Thereafter, the same processes as those in FIG. 1 are done.

FIG. 3 shows an embodiment of a digital system, in which a microcomputer 10*d* and the timer 8 carry out the functions of the magnetic tape or magnetic disk 10*a*, the input unit 10*b* and the output unit 10*c* shown in FIG. 2. That is, an A/D converter and a D/A converter are built in the microcomputer 10*d* to have storage capacity corresponding to $T_1$ time of the natural period at intervals of 1/100 seconds. The output of the multiplier 6 is taken into the microcomputer 10*d* according to the command of the timer 8 at every 1/100 seconds to be recorded therein while the memory address is changed one by one. When the last address is reached, the first address is again returned to rewrite the content. Thus, the memory content of the address immediately next to the present written address shows the output of the multiplier 6 just before $T_1$ time. Then, when this value is output and then input to the subtracter 11 together with the present output of the multiplier 11.

Thereafter, the same processes as those in FIG. 2 are done.

Thus, the work done of the control force within the past $T_1$ time is measured continuously in the embodiment shown in FIG. 2 and at intervals of 1/100 seconds in the embodiment shown in FIG. 3, so that the safety of the structure is judged.

Further, in the embodiment shown in FIG. 3, the timing of the judgement is not limited to every 1/100 seconds, but it can be set to any desired time. For example, in order to judge the safety at intervals of fine time $\Delta t$, as the microcomputer 10*d*, use is made of a microcomputer including the A/D converter and the D/A converter built therein and the having storage capacity of the natural period $T_1 \times (1/\Delta t)$ of the structure.

What is claimed is:

1. In an active seismic induced vibration and/or wind control system for protecting a building, the method of protecting the said system from destructive overload and/or malfunction comprising the steps of:

(a) measuring the speed of movement of said building induced by seismic tremor and/or wind;

(b) measuring the load imposed on the said system during periods of seismic induced vibration and/or wind;

(c) comparing said measured speed of movement of said building with said measured imposed load to obtain a resultant numerical figure;

(d) determining whether said resultant numerical figure exceeds a predetermined numerical figure; and (e) deactivating said system if said resultant numerical figure exceeds said predetermined numerical figure.

2. The method of claim 1, including the steps of determining the natural period of vibration of said building and making observations of said resultant numerical figure at intervals determined by said natural frequency of said building.

3. The method of claim 1, including the steps of:

(a) recording said resultant numerical figure on an analogue recorder;

(b) taking an analogue reading from said analogue recorder each period of vibration of said building;

(c) comparing said analogue reading with said resultant numerical figure to obtain a second resultant numerical figure;

(d) determining whether said second resultant numerical figure exceeds said predetermined numerical figure; and (e) deactivating said system if said second resultant numerical figure exceeds said predetermined numerical figure.

4. The method of claim 1, including the steps of:

(a) recording said resultant numerical figure in a digital micro-computer;

(b) taking a digital reading from said digital microcomputer at a predetermined timed sequence, the frequency of said digital readings being based on the natural period of said building;

(d) comparing each said digital reading with said resultant numerical figure to obtain a second resultant numerical figure;

(e) determining whether said second resultant numerical figure exceeds said predetermined numerical figure; and (f) deactivating said system if said second resultant numerical figure exceeds said predetermined numerical figure.

* * * * *